United States Patent [19]

Bishop

[11] 4,059,929

[45] Nov. 29, 1977

[54] PRECISION METERING SYSTEM FOR THE DELIVERY OF ABRASIVE LAPPING AND POLISHING SLURRIES

[75] Inventor: David C. Bishop, Des Plaines, Ill.

[73] Assignee: Chemical-Ways Corporation, Lake Bluff, Ill.

[21] Appl. No.: 684,972

[22] Filed: May 10, 1976

[51] Int. Cl.[2] ..... B24B 57/00

[52] U.S. Cl. ..... 51/263; 51/292

[58] Field of Search ..... 222/1, 145; 51/263, 51/264, 292

[56] References Cited

U.S. PATENT DOCUMENTS

| | | | |
|---|---|---|---|
| 3,110,991 | 11/1963 | Boettcher | 51/263 |
| 3,162,986 | 12/1964 | Olivieri | 51/263 |
| 3,500,591 | 3/1970 | Gawronski et al. | 51/263 |

*Primary Examiner*—Stanley H. Tollberg
*Assistant Examiner*—Hadd Lane
*Attorney, Agent, or Firm*—Mason, Kolehmainen, Rathburn & Wyss

[57] ABSTRACT

A system for supplying an abrasive-containing liquid to a lapping or polishing machine includes a supply of abrasive slurry concentrate containing abrasive grain which is suspended in a liquid, a supply of diluent liquid which is essentially free from solids, and a mixing chamber positioned relatively close to a desired work surface. The slurry concentrate and diluent are separately conveyed under pressure to the mixing chamber to develop a diluted slurry concentrate which is sufficiently diluted to permit settling out of the abrasive grain. The diluted slurry is then supplied to the work surface.

11 Claims, 6 Drawing Figures

PRECISION METERING SYSTEM FOR THE DELIVERY OF ABRASIVE LAPPING AND POLISHING SLURRIES

The present invention relates to lapping and polishing processes utilizing unbonded abrasive grain carried in a liquid vehicle. While primarily relating to the single surface rotary lapping plate type of machine, the invention also has application to any machining process utilizing said abrasive-and-liquid vehicle. This could include machines for flat, contour, cylindrical or mating surface lapping and polishing.

It is a primary object of the present invention to provide an improved method of feeding the abrasive-and-liquid vehicle, also known as a slurry, to various types of machines, permitting precise control of the amount delivered and of the solids to liquid ratio, while at the same time permitting recovery of the liquid for subsequent reuse in the system.

While currently used feeding systems are quite varied, they are universally limited by the methods of control employed and it is difficult to achieve consistent results, or to obtain maximum economy with such processes. A key problem in such systems is the difficulty in suspending and uniformly dispersing abrasive grain particles, whose size generally ranges from 200 microns to less than 1 micron, and whose specific gravity is up to five times that of the liquids in which it is suspended. Commonly used suspension methods fall into two categories: (1) systems employing constant agitation, and (2) systems employing control of viscosity in order to suspend the abrasive particles by means of a thickened liquid or paste.

Prior art systems employing constant agitation involve the use of a nonsuspending liquid vehicle and are prone to a common problem which is the rapid settling or fall-out of the abrasive grain at any point where agitation may not reach or when agitation stops for any reason. The design or these constant agitation systems usually includes a tank for the abrasive-and-liquid slurry; an agitator, which can be a separate mixing impeller or can be a function of the pump; the pump used for delivering the slurry; the valves used for controlling the flow of the slurry; and the tube carrying the slurry from the tank to the delivery point. The location of the system can be below the delivery point, which requires long delivery tubes, or above the delivery point thereby utilizing gravity feed of the slurry. Examples of such constant agitation systems are shown in U.S. Pat. Nos. 3,261,510 and 3,375,614.

In such constant agitation systems, failure of the suspension can occur at many points. For example, if the agitation is not efficient because of design limitations or because of wear, the abrasive particles will not be uniformly suspended and dispersed throughout the liquid in the tank. If the pump does not carry the slurry with enough force the abrasive will fall out in the tube system and not stay uniformly dispersed. Eddy currents occurring at bends in the tube system or at control points will permit abrasive fall-out and potential blockage. Control valves, by naturally restricting the flow of the slurry, tend to become clogged because of eddy currents forming around the valve opening. Any shutdown of the agitator or pump permits rapid fall-out through the system accelerating uneven dispersion, clogging and blockage. All of these potential problems require constant policing and preventative maintenance resulting in loss of man-hours.

However, the most serious consequence of these problems is a variation in the conditions requisite for uniform processing. The lapping process is dependent on an important ratio of abrasive particles to liquid to obtain uniform cutting or polishing rates and uniform finishes on the parts processed. Unwanted variation in the ratio established for a given part, machine and abrasive type or size will result in unwanted variation in the parts produced. Variations occur such as removing too much stock or too little stock, surface finish deterioration because of too little abrasive, or scratches caused by too much abrasive. In addition, stoppage of the slurry flow and therefore drying of the surfaces can cause galling, scratches, excessive heat build-up and excessive friction resulting in accelerated machine wear and damage to the parts.

Other difficulties in such constant agitation systems include rapid wear of pump and agitator parts, since these elements are continually exposed to highly abrasive slurries. Centrifugal systems, utilizing rapid agitation of the slurry are particularly prone to wear. In gravity feed systems, the flow of the slurry will slow as the tank empties, due to changes in pressure resulting from changes in volume, requiring continual adjustment of the flow rate valve. In addition, manual mixing of the abrasive and liquid is required, usually done by the machine operator. This requires frequent additions to the slurry tank of the abrasive and the liquid during operating cycles. This unscientific mixing is prone to variation due to improper measurement, forgetfulness and inattention to the slurry supply. The natural limitations of the system prevent knowing what the actual abrasive to liquid ratio is in the slurry tank, and adjustment of the ratio relies on guesswork.

While the constant agitation type of system suffers from the above discussed disadvantages, it does have certain advantages from the standpoint of controlling waste disposal and reducing cost, particularly when petroleum oil is used as the liquid vehicle. More particularly, with a constant agitation type of system involving the use of nonsuspending liquids, it is customary to employ a closed loop type of system which enables reuse the oil. This is generally referred to as a "reclaim" system. This reclaim system involves collecting the liquid and waste after the lapping process, allowing the solids to settle out of the liquid during a period of time while the used slurry is not disturbed, and then carefully decanting the "clean" oil from the settled solids. The oil re-enters the lapping process and is reused as the lapping vehicle. Disposal then consists only of the settled and spent solids and of a small portion of the oil remaining with the solids. The reclaim efficiency of such systems is generally in the range of 75 to 90%. While passive settling tank systems are most commonly used, centrifuge and filter sytems are also employed. Where water is the liquid vehicle, similar collecting and settling systems are used, but reuse of the water is not generally intended. However, with the separation of the solids, disposal of the water into waste treatment systems is simplified.

In the other type of prior art system, suspension of the abrasive particles is achieved by employing either a thickened liquid, utilizing agents such as starches, clays, fumed silica or other gellants or thickeners, or by incorporating the abrasive particles in a vehicle of paste-like consistency. In such systems, the abrasive particles are permanently suspended in the thickened liquid or paste. Examples of such systems are shown in U.S. Pat. Nos. 2,944,880, 3,462,251 and 3,817,727.

Systems employing thickened liquids or pastes provide adequate suspension and uniform dispersion but have other problems which limit their usefulness. Pastes, being semi-fluids, will not flow freely and disperse the abrasive grain over large areas, thereby limiting the size of the machine which can be used. Pastes also tend to adhere to the edges of the parts being built up during the lapping process, and a large portion of the paste may not even come in contact with the surface to be lapped resulting in waste. Pastes can also be very difficult to clean, especially if the part has an intricate shape or small holes that fill with the paste, because the solvent which is used after completion of the lapping process must break the thick paste and slowly reduce it to a flowable liquid that can then be washed away along the waste sludge created during the lapping process.

A further important disadvantage of the permanent suspension systems of either the thickened liquid or paste type is that such systems do not permit reclaim and reuse of the liquid used, thereby increasing cost and waste disposal problems of such systems. This is because the collected liquid continues to suspend the spent solids and waste and prevents reclaim of the oil or easy disposal of the water.

It is, therefore, an important object of the present invention to provide a new and improved delivery system for lapping slurries which avoids one or more of the above-described disadvantages of prior art arrangements.

It is another object of the present invention to provide a new and improved method of supplying an abrasive lapping or polishing slurry which precisely controls the slurry flow rate while maintaining suspension of the abrasive particles in the slurry and a desired solid-to-liquid ratio of the slurry.

It is a further object of the invention to provide a new and improved abrasive slurry dispensing system which does not require agitation to maintain suspension of the abrasive particles in the liquid vehicle and yet permits reclaim of the liquid vehicle from the slurry after it is used in a lapping or polishing process.

It is another object of the present invention to provide a new and improved abrasive slurry dispensing system which is capable of precisely regulating the slurry flow rate over a wide range of values without stoppage or clogging of the dispensing system.

It is still another object of the present invention to provide a new and improved abrasive slurry dispensing system which is capable of exact control of the abrasive-to-liquid ratio of the slurry without variation during successive machining cycles.

It is a further object of the present invention to provide a new and improved abrasive slurry delivery system in which positive regulation of the abrasive-to-liquid ratio of the slurry as required by different jobs and machining conditions is achieved, thereby eliminating many man-hours previously devoted to measuring, mixing and policing slurry delivery.

It is another object of the present invention to provide a new and improved abrasive slurry composition which is particularly suitable for use in the slurry delivery system of the present invention.

It is a further object of the present invention to provide a new and improved composition for an abrasive slurry concentrate which may be transmitted long distances without settling of the abrasive particles and upon dilution becomes a nonsuspending slurry from which the liquid thereof may be reclaimed.

Briefly, in accordance with one aspect of the invention, an abrasive-suspending slurry concentrate is supplied in precisely metered amount to the desired point of usage, usually near the rotary table of the lapping machine. A suitable diluent, which may be either water or a water-immiscible organic liquid which is miscible with the organic liquid in the slurry concentrate, depending on the composition of the slurry concentrate, is also supplied in precisely metered amount to the desired point of usage but is kept separate from the slurry concentrate. At the point of usage a mixing or blending chamber is provided of relatively small volume, to which the slurry concentrate and diluent are supplied and blended immediately before usage in the lapping machine. This blending accomplishes two things: (1) it dilutes the slurry concentrate to give the precise abrasive grain to liquid ratio desired for the particular operation, and, in a preferred embodiment, (2) the dilution breaks the suspension characteristics of the slurry concentrate so that the resultant slurry becomes nonsuspending and reclaim of the diluent plus reclaim of the liquid in the slurry concentrate can be accomplished.

Since the slurry concentrate and the diluent are separated until immediately before usage, separate pumps are required for the slurry concentrate and for the diluent. Also, separate feed and delivery tubes are required to bring the two components to the point of usage. Due to the fact that the slurry concentrate maintains the abrasive grain in complete suspension, and the fact that the diluent contains no solids whatsoever, no fall-out or settling of abrasive can occur during such delivery, thereby avoiding the previously mentioned problems of clogging, blockage, lack of uniform abrasive dispersion, and the resultant variation in work produced. Also, by blending the slurry concentrate and diluent to destroy the suspension characteristics of the slurry concentrate and convert it into a nonsuspending slurry at the point at which the slurry is to be used, the abrasive does not have a chance to settle out prior to usage in the lappng process but may thereafter be separated from the diluent so that the diluent may be reused, in the case of an oil diluent, or may be readily disposed of, in the case of a water diluent.

In accordance with a further aspect of the invention, the abrasive suspending slurry concentrate is formed by incorporating an emulsifier into the concentrate which promotes the conversion of the concentrate into a nonsuspending slurry when the diluent is added during the blending operation. When a water-immiscible organic liquid based concentrate is used, the abrasive is suspended by a balanced water-in-oil structural emulsion. In a water-based system a similar emulsifier is used to achieve suspension by a detergent thickening effect.

For any particular emulsifier there is an important balance point for that emulsion which produces the proper level of thickening necessary to fully suspend the abrasive particles. Alteration of the balance upon blending with the diluent will convert the concentrate to a nonsuspending slurry from which the abrasive may eventually be settled out.

The invention, both as to its organization and method of operation, together with further objects and advantages thereof, will best be understood by reference to the following specification taken in connection with the accompanying drawings in which.

Figure 1:
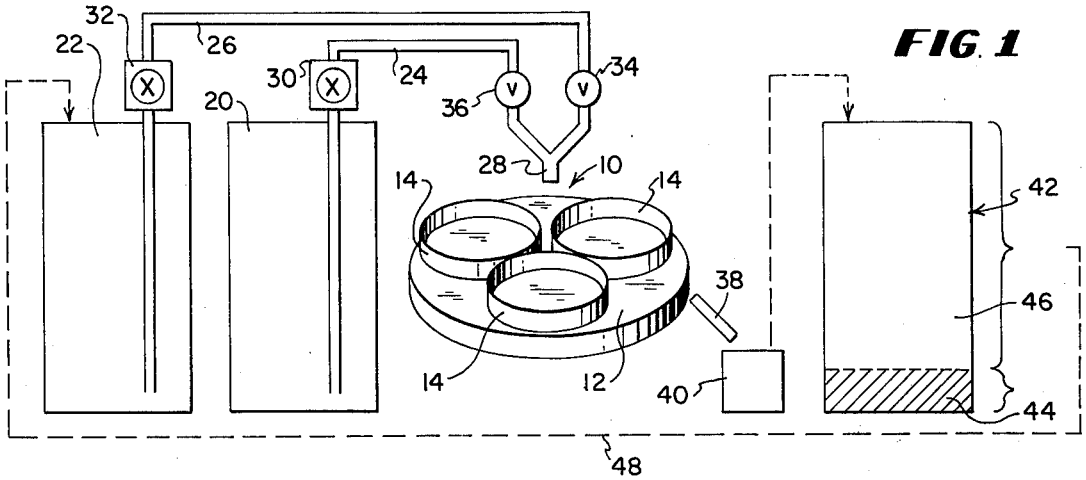
FIG. 1 is a diagrammatic view of a lapping compound delivery and recovery system embodying the features of the present invention.
Figure 2:
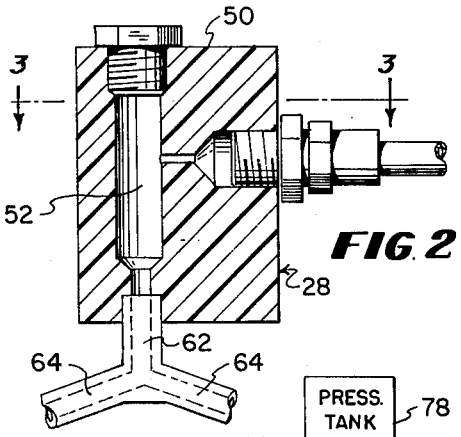
FIG. 2 is a cross-sectional view of the mixing chamber employed in the system of FIG. 1.
Figure 3:
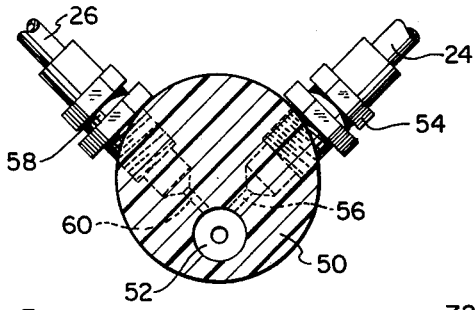
FIG. 3 is a sectional view taken along the line 3—3 of FIG. 2.

Referring now to the drawings, and more particularly to FIGS. 1 to 3, thereof, the present invention is therein illustrated in connection with a lapping machine indicated generally at 10. This lapping machine may be of conventional design, such as shown for example in U.S. Pat. No. 3,375,614. While reference may be had to this patent for a detailed description of such a machine, for the purposes of the present invention it may be stated generally that the lapping machine comprises a rotary lapping disc or table 12 on which the work pieces are placed and a plurality of pressure plates 14, which are movable on vertical spindles (not shown) are employed to press the articles which are to be lapped against the rotary lapping disc 12, a plurality of truing and retaining rings (not shown) usually being provided around the outside edge of the pressure plates 14 to hold the parts beneath these plates. Conventionally, a lapping compound which consists of a free flowing mixture of abrasive particles and an oil or water base carrier, is fed to the lapping disc 12 through discharge tubes positioned centrally over the disc 12 so that the parts to be lapped ride on a thin film of this abrasive mixture which covers the surface of the lapping disc 12. In conventional lapping machines this lapping compound is supplied from a tank positioned above or below the rotary lapping disc 12. In order to maintain the abrasive particles in suspension until they have been deposited on the lapping disc 12 conventional systems usually provide an agitator, either within the tank or as a function of the pump employed to delivery the slurry to the central point of usage over the disc 12, with the attendant disadvantages discussed in detail heretofore.

In accordance with the present invention applicant provides a first supply tank 20 which contains an abrasive particle suspending slurry concentrate, and a second supply tank 22 which contains a suitable diluent, which may be either oil or water. In accordance with an important aspect of the invention, the tanks 20 and 22 may be positioned a considerable distance from the lapping machine and the contents thereof are fed through the separate supply lines 24 and 26, respectively, to a suitable mixing head indicated generally at 28 which is positioned at the point of usage of the lapping compound, i.e. immediately over the center portion of the lapping disc 12. The contents of each of the tanks 20 and 22 are supplied to the mixing chamber by means of positive displacement metering pumps 30 and 32.

Each of the pumps 30 and 32 preferably has a precisely variable output control so that the amount of slurry concentrate in the tank 20 or diluent in the tank 22 may be adjusted to provide positive regulation of the abrasive to liquid ratio developed in the mixing head 28. Shutoff valves 34 and 36 may be provided in the lines 24 and 26, respectively, to shut off the flow of lapping compounds to the disc 12 when desired.

The pumps 30 and 32 may be of the gear, piston, diaphragm or other positive displacement type, the diaphragm type being considered to be the best for the present invention because of its resistance to abrasive wear. A chemical feed pump model 2–120 manufactured by the CHEM-TECH International Company has been found to be satisfactory. In the alternative, supply of the slurry concentrate in the tank 20, or the diluent in the tank 22 may be accomplished by means of a suitable air pressure system similar to those used in paint spraying.

In accordance with an important aspect of the invention, the slurry concentrate in the tank 20 completely suspends the abrasive particles and has a relatively high ratio of abrasive particles to liquid so that the slurry concentrate is in the form of a very thick but flowable slurry. For the majority of applications the slurry concentrate will consist of approximately 33% liquid and 67% abrasive grain by weight of the total slurry concentrate. However, the slurry concentrate can consist of from 20% liquid and 80% abrasive, by weight, to 60% liquid and 40% abrasive, by weight, for special requirements. In the following examples the ratio of 33 to 67 will be used as an example.

The diluent in the tank 22 contains no abrasive particles and is transmitted to the mixing head 28 by means of the metering pump 32 over the separate supply line 26. Since the slurry concentrate in the tank 20 maintains the abrasive particles in complete suspension and the diluent contains no abrasive particles whatsoever, the tanks 20 and 22 may be positioned a substantial distance away from the lapping disc, or may be used for multiple machines, as will be described in more detail hereinafter in connection with FIG. 4, without encountering any problems of settling of the abrasive particles with the attendant problems of clogging, blockage, lack of uniform abrasive dispersion and resultant variation work, as described in detail heretofore.

In accordance with a further important aspect of the invention, suspension of the abrasive particles in the slurry concentrate is employed by providing an emulsifying agent which produces a dispersion suitable for fully suspending the abrasive particles even at the high abrasive particle to liquid ratios mentioned above. There is a balance point for the emulsion in order to fully suspend the abrasive. However, in accordance with an important embodiment of this invention, when the slurry concentrate is mixed or blended with the diluent in the mixing head 28, the balance of the emulsion is altered so that the slurry which is deposited on the rotary lapping disc 12 is no longer capable of suspending the abrasive particles. This means that after the slurry has been used for the lapping process on the disc 12, it is supplied through the chute 38 to the waste tank 40. The contents of the tank 40 are periodically emptied into a settling tank 42 and since the slurry is now incapable of suspending the abrasive particles, these particles are collected, together with the waste produced during the lapping process, at the bottom of the tank 42, as indicated at 44 in FIG. 1. The diluent 46 is thus separated from the abrasive particles and may be reclaimed for reuse in the dispensing system, as indicated by the dotted line 48 in FIG. 1 which indicates that the diluent may be returned to the tank 22 for reuse. When the diluent is water, it is not normally reused, but may be readily disposed of since it has been separated from the abrasive particles and sludge 44.

Referring now to FIGS. 2 and 3, wherein the mixing head 28 is shown in more detail, this element is shown as comprising a block 50 having a vertically extending mixing chamber 52 to which the slurry concentrate and diluent are supplied over the supply lines 24 and 26. More particularly, the line 24 is connected to the block 50 through a suitable fitting 54 and the slurry concentrate is supplied through the inlet 56 to the chamber 52. In a similar manner the line 26 is connected to a fitting 58 and the inlet 60 to the chamber 52. Preferably the mixing chamber 52 is of relatively small capacity. While this capacity can vary with different requirements it is generally less than 3 oz. so that once the slurry concentrate in the supply line 24 is converted to a nonsuspending slurry in the chamber 52 it is immediately supplied over the outlet 62 and discharge tubes 64 onto the surface of the lapping disc 12 without any opportunity for the abrasive particles to settle out and cause blockage or clogging. Also, since the chamber 52 is vertical, when the valves 34 and 36 are closed, the slurry in the chamber 52 drains out by gravity so that no blockage will occur when the system is again started.

Blending or mixing of the slurry concentrate with the diluent in the chamber 52 accomplishes two functions. First, the slurry concentrate is diluted so as to give the precise abrasive particle to liquid ratio desired for a particular operation. Secondly, the dilution breaks the suspension characteristics so that reclaim of the diluent plus reclaim of the liquid in the slurry concentrate can be accomplished.

Any abrasive grain type or size can be used in the slurry concentrate. The most commonly used abrasives are aluminum oxide, silicon carbide, boron carbide, diamond, garnet, corundum, emery, silica, tripoli and various metallic oxides. Abrasive grain particle size ranges from approximately 200 microns at the coarsest to 0.25 micron at the finest. Particle size designations generally refer to the average particle size within a grading. Abrasives can be held in approximately 40 specific grading averages from the coarsest to the finest. Each abrasive grain size and each abrasive grain type will have different applications depending on the exact results desired from the lapping or polishing process.

Blending of the slurry concentrate and the diluent is dependent upon the precise metering control provided by the positive displacement metering pumps 30 and 32. This blending takes place immediately before use in the mixing chamber 52 and this mixing insures homogeneous blending of the slurry concentrate and the diluent before dispensing onto the lapping surface. In most lapping and polishing applications the abrasive grain to vehicle ratio will range from a low of 10% to a high of 50% by weight. For most applications, the slurry concentrate is designed to be blended with the diluent at ratios ranging from one part slurry concentrate to one part diluent, up to one part slurry concentrate to nine parts diluent by volume. The exact ratio of the blend is determined by the abrasive grain type and size, by the cutting rate and surface finish desired, and by the type and size of machine being used. Due to the fact that the input of slurry and diluent is known, the ratio of the blend can easily be set by the operator by adjusting the controls of the positive displacement pumps 30 and 32.

For example, slurry concentrate containing a 40 micron aluminum oxide, and using the 33% liquid to 67% abrasive ratio, will have a specific gravity of 14.5 lbs. per gallon of which 9.7 lbs. are abrasive. If a ratio of 1 pound abrasive to 1 gallon of liquid is desired, the diluent pump would be set to deliver nine times the volume of the slurry pump. In this illustration a water-immiscible organic diluent having a specific gravity of 7 lbs. per gallon will be used.

---

Slurry pump delivering 1 gallon of slurry per unit of time equals:
9.7 lbs. abrasive and 4.8 lbs. liquid
Diluent pump delivery of 9 gallons of slurry per unit of time equals:
9 gallons × 7 lbs. = 63 lbs. water-immiscible organic liquid
Totals therefore are:
9.7 lbs. abrasive
67.8 lbs. organic liquid at 7 lbs. per gallon equals 9.7 gallons
Final ratio is:
1 lb. abrasive to 1 gallon liquid

---

If 3 lbs. of abrasive were desired per gallon of liquid the diluent pump would be set to deliver 2.5 times the volume of the slurry pump.

---

Slurry pump:
9.7 lbs. abrasive and 4.8 lbs liquid
Diluent pump:
2.5 gallons × 7 lbs. = 17.5 lbs.
Totals:
9.7 lbs. abrasive
22.3 lbs. organic liquid at 7 lbs. per gallon equals 3.2 gallons
Final ratio is:
3 lbs. abrasive to 1 gallon liquid

---

Figure 5:
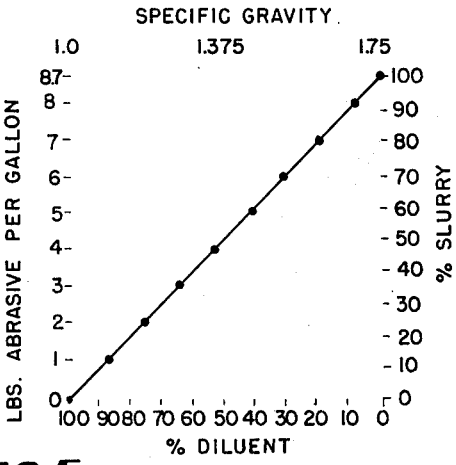
FIG. 5 is a graph illustrating the manner in which a desired number of pounds of abrasive per gallon of liquid may be selected in the system of FIG. 1.

In accordance with a further important aspect of the invention, the desired abrasive to liquid ratio and the desired flow rate for a particular slurry concentrate may be readily be chosen by employing charts corresponding to that particular slurry concentrate. These charts also permit the user to check periodically to be sure the desired mixing ratio and flow rate are being maintained. Thus, a desired mixing ratio for a particular slurry concentrate may be determined by employing ratio chart such as shown in FIG. 5. Referring to this figure, the curve shown therein correlates pounds of abrasive per gallon, the percentages of slurry concentrate and diluent required to obtain a given number of pounds of abrasive per gallon, and the specific gravity of the resultant slurry. The particular slurry concentrate shown in FIG. 5 is a water base slurry concentrate and hence the diluent has a specific gravity of 1. This specific slurry concentrate has a specific gravity of 1.75. If, for example, 2 pounds of abrasive per gallon is required, the curve of FIG. 5 shows that a mixing ratio of approximately 20% slurry concentrate and 80% diluent (water) should be used. This mixture will give a specific gravity of approximately 1.15, as shown by the top scale abscissa of the graph of FIG. 5. The operator may periodically check whether or not this mixing ratio is being maintained by filling a container with 100 cc. of the mixture from the mixing head 28 and weighing the sample to determine its specific gravity.

Figure 6:
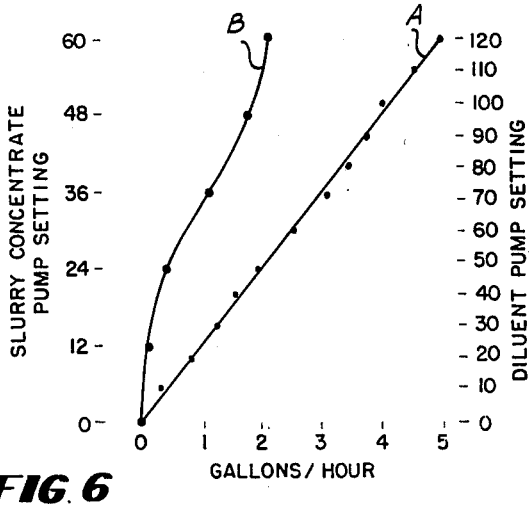
FIG. 6 is a further graph illustrating the setting of the positive displacement pumps in the system of FIG. 1 to provide a desired consistency of slurry in that system.

The required flow ratio of slurry concentrate and diluent may also be determined by referring to the chart of FIG. 6. In this chart the setting of the slurry concentrate pump 30 is given along the left-hand ordinate, the setting of the diluent pump 32 along the right-hand ordinate and the flow rate in gallons per hour along the abscissa. The rate of the slurry pump 30 can be varied from zero to 60 gallons/day of water and the rate of the diluent pump 32 from zero to 120 gallons/day of water. A pump with higher displacement rate is usually chosen for the diluent and both pump settings are preferably chosen so that they are normally in the mid range of the total pump operating range. In the above example, if a total flow rate of 2 gallons per hour is required and 80% diluent is determined from FIG. 5, a flow rate of 1.6 gallons/hour of the diluent may be determined from curve A of FIG. 6. A setting of 40 for pump 32 is required to give this flow rate. In a similar manner, for 20% slurry, a flow rate of 0.6 gal./hr. may be determined from curve B of FIG. 6. A setting of 26 for pump 30 is required to give this flow rate. After these flow rates have been established they are positively maintained without change due to the fact that accurately metering positive displacement pumps are employed in accordance with the present invention.

The second function accomplished by the blending in the chamber 52 is that upon dilution with the diluent, the chemical ratios in the slurry concentrate are radically changed and the emulsion can no longer be sustained so that suspension of the abrasive particles fails. The slurry concentrate is thus converted into a nonsuspending slurry which is immediately deposited on the rotating lapping disc 12. Furthermore, surface area exposure and heat generated during usage evaporate water from the oil emulsion suspensions, thereby further accelerating suspension failure. This means that common suspension methods, for example the "mechanical" additives, such as clay, fumed silica, and starch gellants, can only be used in limited quantities in the slurry concentrate. However, they are effective and can be used in small amounts for assisting suspension and viscosity control. In large amounts these mechanical additives prevent full reclaim in the diluent because breaking of the mechanical suspension is very difficult.

The liquid concentrate (without abrasive) should have a viscosity of at least 600 centipoises at 68° F., when measured with a Brookfield viscometer model LVT using spindle No. 3, at 12 rpm in order to fully suspend large amounts of 40–80% by weight of the total slurry concentrate. Below 600 centipoises 40–80% by weight abrasive cannot be suspended, even by a stable liquid concentrate emulsion. In addition to the increase in viscosity, the emulsifier must provide a stable emlusion of the liquid concentrate to fully suspend 40–80% by weight abrasive particles. For slurry concentrates containing one or more water-immiscible organic liquids, typical formulae for the liquid concentrate and slurry concentrate compositions, in percent by weight, are as follows:

| | Liquid Concentrate | Concentrate Plus Abrasive |
|---|---|---|
| Emulsifier | 15% | 5% |
| Water-immiscible organic liquid | 82 | 27 |
| Water | 3 | 1 |
| Abrasive | — | 67 |

The water-based compositions have the following general formulae for typical liquid concentrate and slurry concentrate compositions, in percent by weight:

| | | |
|---|---|---|
| Emulsifier | 15 | 5 |
| Water | 85 | 27 |

-continued

| | | |
|---|---|---|
| Abrasive | — | 67 |

Specific examples of suitable water-immiscible organic liquid concentrate and organic liquid-based slurry concentrate compositions are as follows:

| | Liquid Concentrate | Slurry Concentrate |
|---|---|---|
| Oleic acid | 16% | 6% |
| Triethanolamine | 8% | 3% |
| Kerosene distillate | 73% | 24% |
| Water | 3% | 1% |
| Abrasive | — | 66% |

where percents are by weight.

Specific examples of suitable water-based liquid concentrate and water-based slurry concentrate compositions are as follows:

| | Liquid Concentrate | Slurry Concentrate |
|---|---|---|
| Oleic acid | 10% | 4% |
| Triethanolamine | 5% | 2% |
| Water | 85% | 27% |
| Abrasive | — | 67% |

By diluting the slurry concentrate in mixing head 28, the resulting diluted slurry becomes nonsuspending resulting in abrasive fall-out.

The above specific kerosene-containing slurry concentrate is diluted by adding 20% kerosene, by weight of liquid concentrate, to render the diluted lapping composition nonsuspending. The above specific water-based slurry concentrate is diluted by adding 50% water, by weight of liquid concentrate, to render the diluted lapping composition nonsuspending.

Figure 4:
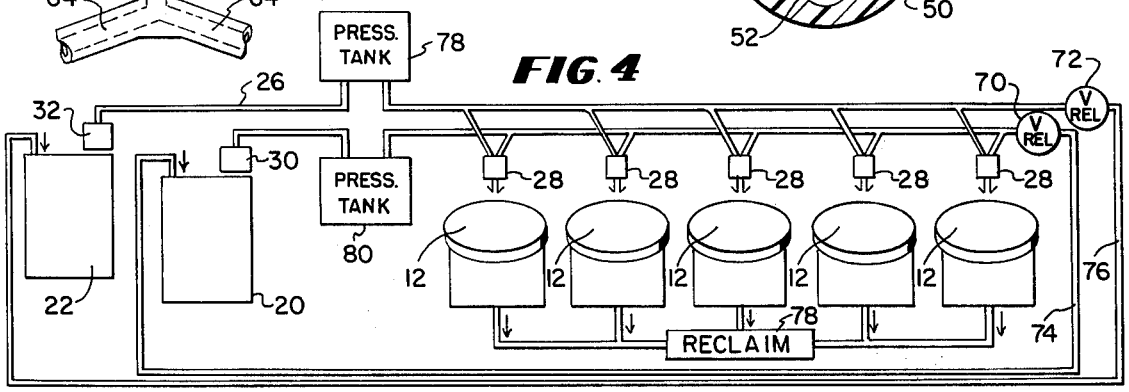
FIG. 4 is a diagrammatic view of an alternative embodiment of the invention wherein a delivery system for several machines is provided.

The arrangement of the present invention is also particularly suitable for use as a central dispensing system for a plurality of lapping or polishing machines. Thus, as shown in FIG. 4, the tank 20 of slurry concentrate and tank 22 of diluent may be located at any convenient location and the outlet lines 24 and 26, from the positive displacement metering pumps 30 and 32, may be employed as common header lines to a number of mixing heads 28 individually associated with respective lapping tables 12. Pressure relief valves 70 and 72 may be employed in the lines 24 and 26 to maintain uniform pressure in the headers supplying the mixing heads 28. Return lines 74 and 76 may be employed to return the excess slurry concentrate and diluent to the tanks 20 and 22, respectively. As described generally heretofore in connection with the system of FIGS. 1 to 3, the slurry concentrate provides an emulsion type suspension system for the abrasive particles which is changed to a nonsuspending slurry in each of the mixing heads 28. Accordingly, the used slurry and waste from the tables 12 may be reclaimed by any suitable settling tank arrangement, indicated generally by the reclaimed tank 78 in FIG. 4, and returned to the diluent tank 22 for further use if an oil soluble system is being employed.

While there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A system for supplying an abrasive-containing liquid to a machine for use therein which comprises, a supply of abrasive slurry concentrate containing abrasive grain which is suspended in a liquid containing sufficient emulsifying agent to suspend the abrasive grain, a supply of diluent liquid incapable of suspending the grain, a mixing chamber positioned relatively close to a desired work surface, means for separately conveying said slurry concentrate and said diluent to said mixing chamber to develop a diluted slurry concentrate in which the concentration of emulsifying agent is insufficient to suspend the grain such that at least a substantial portion of the liquid can be separated from the abrasive grain in said diluted slurry concentrate substantially immediately after use, and means for supplying said diluted slurry concentrate to said work surface.

2. The system as defined in claim 1 which includes means for separating a substantial portion of the abrasive grain from the liquid in said diluted slurry concentrate.

3. The system as defined in claim 1 wherein the slurry concentrate contains abrasive grain in an amount of 40–80% by weight of total slurry concentrate.

4. In a lapping or polishing machine having a work surface to which a lapping or polishing compound is to be delivered, the combination which includes means for providing an abrasive slurry concentrate containing abrasive grain which is suspended in a liquid containing sufficient suspending components to suspend the abrasive grain, said slurry concentrate capable of being transmitted a substantial distance without said abrasive grain settling out of said concentrate, means for providing a liquid diluent essentially free from solids, said liquid diluent being incapable of suspending the grain when combined with said slurry concentrate, means for separately conveying said slurry concentrate and said diluent to a mixing station means for adding said diluent to said slurry concentrate to provide a diluted composition at said mixing station and to cause substantially immediate settling out of said abrasive grain, means for supplying said diluted composition to said work surface, means for collecting said liquid after it has been used in the machine, and means for separating the liquid from the abrasive grain in said diluted composition.

5. In a lapping machine system, the combination which includes means for providing a supply of abrasive-grain-suspending slurry concentrate having sufficient emulsifying agent to fully suspend said abrasive grain, and means for blending said slurry concentrate with a diluent substantially immediately before usage in the lapping process, said diluent being incapable of suspending said abrasive grain, to provide a diluted slurry concentrate in which the abrasive grain is capable of being separated from the liquid substantially immediately after usage in said lapping machine.

6. A system as defined in claim 5, wherein said slurry concentrate includes a water-immiscible organic liquid which can be separated from the abrasive grain in said slurry concentrate.

7. A system as defined in claim 5, wherein said slurry concentrate contains at least 40% abrasive grain by weight of slurry concentrate.

8. Apparatus for lapping a surface, comprising means for supplying a slurry concentrate composition comprising at least 40% abrasive particles by weight said concentrate composition having a viscosity at 68° F. of at least 600 centipoises, and having sufficient emulsifying agent to suspend said abrasive grain, means for mixing a diluent with said slurry concentrate composition in an amount sufficient to break the suspension characteristics of said slurry concentrate composition thereby permitting abrasive fall-out in the resultant lapping composition, and means for delivering said resultant lapping composition to a work surface.

9. The method of supplying an abrasive containing liquid to a machine for use therein which comprises the steps of, providing a supply of abrasive slurry concentrate containing abrasive grain in an amount of at least 40% by weight suspended in a liquid, said slurry concentrate containing sufficient suspending components to suspend the abrasive grain, providing a supply of diluent liquid incapable of suspending said abrasive grain, conveying said slurry concentrate and said diluent to a mixing station to develop a diluted slurry concentrate therein, supplying said diluted slurry concentrate to a work surface for use thereon, adding additional diluent to said diluted slurry concentrate after use of said diluted slurry concentrate in said machine to break the suspending characteristics of said diluted slurry concentrate after use of said diluted slurry concentrate in said machine so that the concentration of suspending components is insufficient to suspend the abrasive grain, to cause at least a substantial portion of said abrasive particles to settle out of said diluted slurry concentrate, and separating at least a substantial portion of the liquid from said settled abrasive particles.

10. The method of supplying an abrasive containing liquid to a machine for use therein which comprises the steps of: providing a slurry concentrate composition including abrasive particles suspended in a liquid wherein said liquid includes a sufficient amount of emulsifying agent to form a stable emulsion comprising 30–96% water-immiscible organic liquid, by weight of total liquid; 1–20% water, by weight of total liquid; and 3–50% emulsifier, by weight of total liquid; providing a water-immiscible organic liquid diluent which is incapable of suspending the abrasive grain and which is miscible with said water-immiscible organic liquid of said concentrated abrasive composition; continuously and separately conveying said diluent and said slurry concentrate composition to a mixing station to develop a diluted slurry concentrate in which the concentration of emulsifying agent is insufficient to suspend the abrasive grain, said diluent being supplied to said mixing station in an amount sufficient to break the abrasive particle suspension characteristic of said slurry concentrate, and delivering said diluted slurry concentrate to a work surface.

11. The method of claim 10, which includes the step of separating a substantial portion of the liquid from the abrasive particles of said diluted slurry concentrate after it has been used on said work surface.

* * * * *